US005626071A

United States Patent [19]

Schneider et al.

[11] Patent Number: 5,626,071

[45] Date of Patent: May 6, 1997

[54] HYDRAULIC RAM WITH ADJUSTABLE STOP

[75] Inventors: Dominik Schneider, Chur; Markus Engler, Zizers, both of Switzerland

[73] Assignee: Eckold AG, Rheinstrawse, Switzerland

[21] Appl. No.: 532,922

[22] Filed: Sep. 22, 1995

[30] Foreign Application Priority Data

Sep. 28, 1994 [DE] Germany ..... 44 34 665.4

[51] Int. Cl.[6] ..... F01B 31/14

[52] U.S. Cl. ..... 92/13.8

[58] Field of Search ..... 92/5 R, 13, 13.8, 92/17

[56] References Cited

U.S. PATENT DOCUMENTS

| | | | |
|---|---|---|---|
| 2,492,200 | 12/1949 | Stieglitz | 92/5 R X |
| 2,605,748 | 8/1952 | Rasoletti | 92/13 X |
| 2,640,325 | 6/1953 | Haller | 92/5 R X |
| 2,736,294 | 2/1956 | Buehner . | |
| 3,407,710 | 10/1968 | Weiss | 92/13.8 |
| 3,815,480 | 6/1974 | Spyra | 92/13.8 X |
| 4,198,844 | 4/1980 | Lowe et al. | 92/13.8 X |

FOREIGN PATENT DOCUMENTS

| | | |
|---|---|---|
| 2231873 | 12/1974 | France . |
| 1301943 | 8/1969 | Germany . |

*Primary Examiner*—John E. Ryznic

*Attorney, Agent, or Firm*—Townsend and Townsend and Crew LLP

[57] ABSTRACT

A hydraulic ram including a stop system which defines a piston stroke. The stop system may be adjusted and the set position of the stop member may be coarsely read from graduation of a scale member while an adjustment ring has a finely graduated scale.

14 Claims, 2 Drawing Sheets

HYDRAULIC RAM WITH ADJUSTABLE STOP

BACKGROUND OF THE INVENTION

The present invention relates to a hydraulic ram suited to actuate tools or the like where it is desirable to detect and adjust the stroke of a piston within a cylinder.

German published patent application DE-A-37 05 190 discloses a cylinder-piston-assembly wherein the piston is displaced by a pressurized fluid. A stop member is screwed to a piston rod which extends through one end of the cylinder. The stop member is provided with a number of circumferential grooves so that its position relative to the piston rod may coarsely be read.

In other known systems, the piston stroke is sensed by electronic means which, however, is costly and nevertheless insufficiently accurate.

BRIEF DESCRIPTION OF THE DRAWINGS

It is an object of the present invention to provide a hydraulic ram having stroke adjustment means of high precision in the order of a tenth of a millimeter or even better.

SUMMARY OF THE INVENTION

The invention proposes a hydraulic ram, comprising:

a tubular cylinder, a piston slidably displaceable within the cylinder, a cylinder head connected to one end of the cylinder, a stop member screwed unto the piston and rotatable relative to the piston to thereby adjust the working stroke of the piston relative to the cylinder, and a counter stop member within the cylinder head. An adjustment ring is rotatably mounted on the cylinder head but in an axially fixed position, and the adjustment ring is coupled to the stop member such that the latter is driven to rotate with the adjustment ring but is axially displaceable relative to the ring. This arrangement permits accurate reading of the angular position of the adjustment ring and thus of the axial position of the stop member.

The reading will be the more precise the more rotations of the adjustment ring are provided for axially displacing the stop member by a predetermined amount. Therefore, the ram comprises preferably a coarse scale and a fine scale, the fine scale being established by index marks along a circumference of the adjustment ring. The coarse scale may be provided on a scale member which can be withdrawn from the cylinder head and which senses mechanically the actual axial position of the stop member. A similar coarse and fine scale design is known from German published patent application DE-A-28 27 774.

Once the piston stroke is adjusted, it is reproducibly fixed in that preferably rotation of the adjustment ring is blocked. Such blocking is preferably caused by the scale member being pushed back. Preferably, the scale member is slidably received within the adjustment ring so that the stop member, the adjustment ring, and the scale member are commonly rotatable relative to the piston.

A preferred embodiment of the hydraulic ram in accordance with the present invention will now be described with reference to the accompanying drawings.

Figure 1:
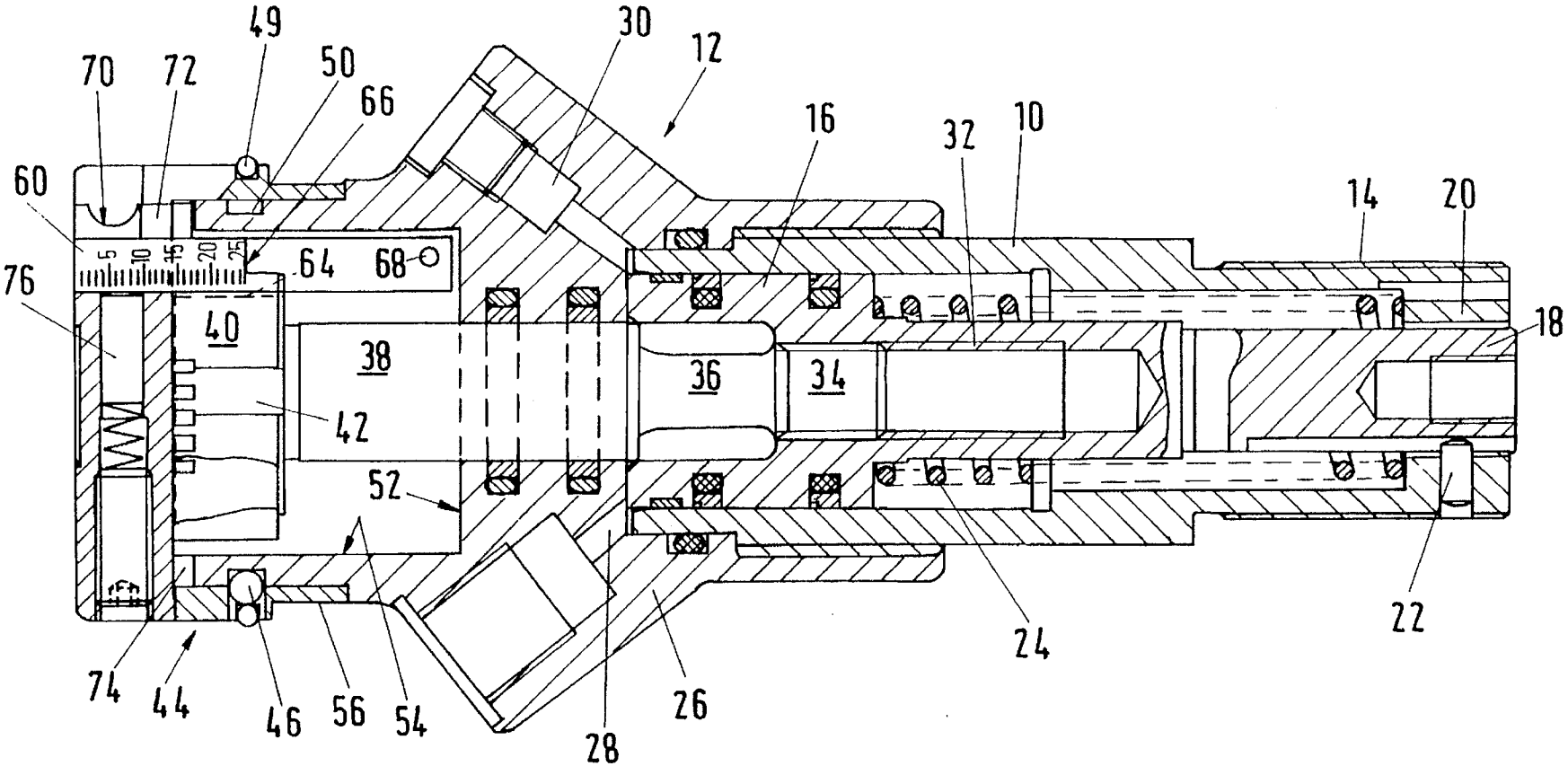
Figure 3:
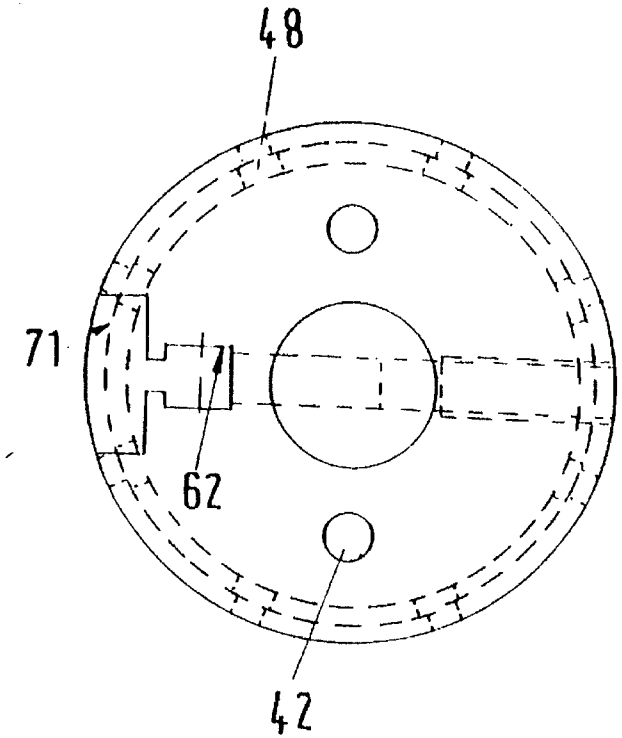
Figure 2:
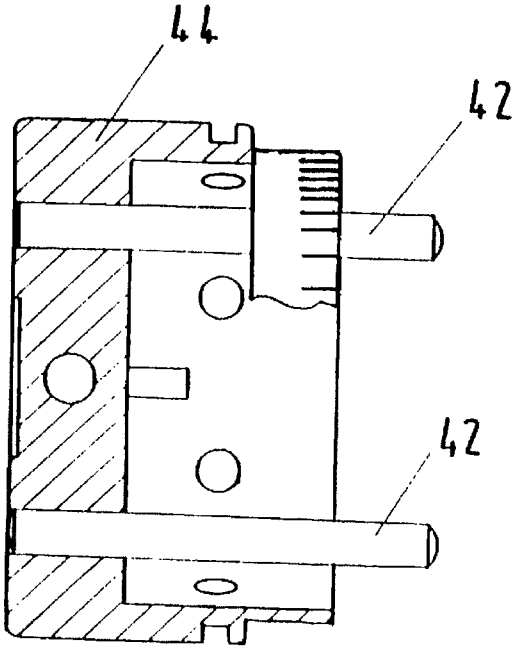

FIG. 1 is a axial section view of the hydraulic ram,

FIG. 2 is an an axial section view of the adjustment ring in FIG. 1,

FIG. 3 is a front view of the adjustment ring of FIG. 2, and

Figure 4:
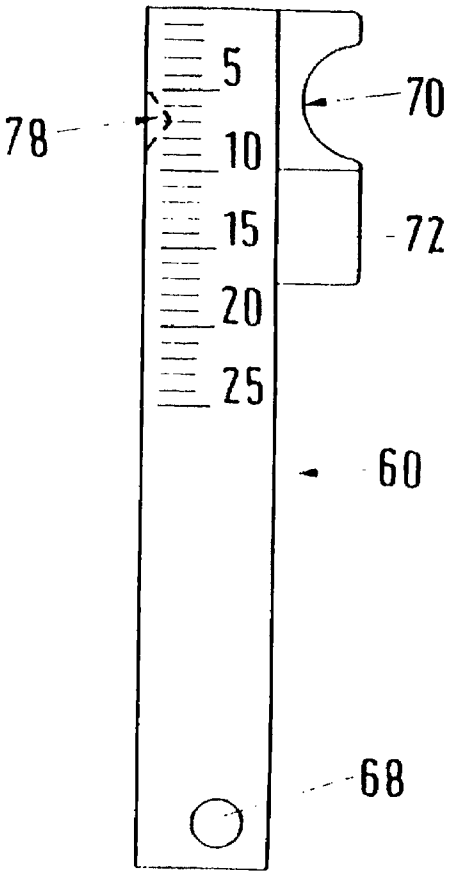

FIG. 4 is a side view of the scale member in FIG. 1.

DESCRIPTION OF THE SPECIFIC EMBODIMENTS

The hydraulic ram comprises a cylinder tube 10 of which one end is screwed into a cylinder head 12 in a fluid-tight manner. The other end of the cylinder tube has screw threads 14 enabling coupling of the ram to an apparatus such as a tool to be driven by the ram. A piston 16 is slidably and sealingly received in cylinder tube 10. Rod 18 of piston 16 extends through the bottom 20 of the cylinder tube, rotation of the piston relative to the cylinder being blocked by a pin 22 which extends into a groove of the piston rod.

In the illustrated embodiment, the ram is hydraulically actuable into only one direction so that piston 16 is displaced to the right in FIG. 1 while its initial position is restored by means of spring 24 interposed between piston 16 and tube bottom 20. The cylinder head comprises a flange 26 provided with a bore 28 for pressurized oil supply, and a flange 30 including a venting mechanism. The ram described so far is conventional.

In accordance with the invention, piston 16 has an inner screw thread 32, and a stop member is screwed thereinto. The stop member comprises, from right to left in FIG. 1, successively and in coaxial arrangement, bolt thread portion 34, shaft 36, slider 38 sealingly engaging a cylinder head bore, and a stop head 40. The latter comprises diametrically opposite grooves extending parallel to the ram axis and having semi-circular cross section shape. An adjustment ring 44 carries two bolts 42 each in slidable engagement with one of the stop head grooves, these bolts extending inwards with respect to the cylinder head.

Adjustment ring 44 is rotatably journalled on the cylinder head by means of eight balls 46 received in bores 48 of the ring and rolling in a circumferential groove 50 of the cylinder head. The balls are held by a circlip 49. Upon rotation of adjustment ring 44, the angular displacement thereof is transmitted to the stop member via bolts 42, thereby axially displacing the stop member so as to vary its distance from the counter stop member which, in this embodiment, is a shoulder 52 at the inner end of a bore 54 of the cylinder head. In FIG. 1, stop member head 40 abuts the inner face of the adjustment ring which defines the greatest possible stroke.

The pitch of the thread 34 coupling stop member and piston is selected such that one full turn of the adjustment ring produces an axial displacement of two millimeters of the stop member. A circumferential fine scale 56 provided on the adjustment ring thus permits reading of fractions of millimeters. In this embodiment, the scale comprises index marks the spacing of which corresponds to 5/100 millimeters.

A scale member 60 is provided for coarse detection of the stop member position. The scale member has a millimeter graduation. Scale member 60 extends through a guide opening 62 of the adjustment ring 44 and engages into a recess 64 of the stop member head which is parallel to the ram axis. The stop head has a step 66 at its inner end. If the scale member 60 is pulled a sensor pin 68 adjacent its end hits step 66 so that the portion of the scale member extending beyond the adjustment ring enables coarse reading of the stop head position.

Scale member 60 has a finger grip recess 70, and adjustment ring 44 has an opening 71 at the respective angular position so that the finger grip recess is accessible when the scale member is pushed home. Adjustment ring 44 is rotatable only when scale member 60 is withdrawn because when the latter is pushed home a nose 72 beneath recess 70 engages into one of twenty slots 74 provided on the free end of the cylinder head and allocated to a respective index mark on the fine scale. A spring-biased index bolt 76 is in engagement with a notch 78 of scale member 60 when the latter is pushed home so as to fix it against inadvertent outward movement which otherwise could occur if e.g. the ram is used such that the working direction of the piston is vertically upwards.

What is claimed is:

1. A hydraulic ram comprising:

a tubular cylinder having a head end and a bottom end;

a piston slidably received in the tubular cylinder;

a cylinder head secured to the head end of the tubular cylinder;

a stop member threadably received in the piston and extending from the piston toward the cylinder head, wherein rotation of the stop member axially displaces the stop member relative to the piston;

a counter stop member in the cylinder head disposed so that said counter stop member engages the stop member to limit travel of the piston toward the bottom of the cylinder; and an adjustment ring rotatably mounted on the cylinder head, wherein the adjustment ring is coupleable to the stop member so that rotation of the adjustment ring can rotate and axially position the stop member relative to the cylinder.

2. The hydraulic ram of claim 1 further comprising a coarse scale and a fine scale.

3. The hydraulic ram of claim 2 wherein said coarse scale is carried by a scale member which is disposed in the cylinder head and which can be withdrawn from said cylinder head and which mechanically senses an axial position of said stop member.

4. The hydraulic ram of claim 3 wherein said scale member is slidably received in said adjustment ring.

5. The hydraulic ram of claim 3 wherein rotation of said adjustment ring is blocked when said course scale member is present in the cylinder head.

6. The hydraulic ram of claim 3 wherein said fine scale comprises index marks provided along a circumference of said adjustment ring.

7. The hydraulic ram of claim 1 wherein said adjustment ring is mounted on a free end of said cylinder head.

8. A hydraulic ram, comprising:

a tubular cylinder, a piston slidably displaceable within said cylinder, a cylinder head connected to one end of said cylinder, a stop member screwed unto said piston and rotatable relative to said piston to thereby adjust a working stroke of said piston relative to said cylinder, and a counter stop member within said cylinder head, wherein an adjustment ring is rotatably mounted on said cylinder head in an axially fixed position, said adjustment ring being rotatably coupled to said stop member such that the latter is axially displaceable relative to said adjustment ring, and a scale being provided on said adjustment ring so as to enable reading of said stroke.

9. The hydraulic ram of claim 8 comprising a coarse scale and a fine scale.

10. The hydraulic ram of claim 9 wherein said coarse scale is carried by a scale member which can be withdrawn from said cylinder head and which mechanically senses an axial position of said stop member.

11. The hydraulic ram of claim 10 wherein rotation of said adjustment ring is blocked unless said course scale member is withdrawn.

12. The hydraulic ram of claim 9 wherein said fine scale comprises index marks provided along a circumference of said adjustment ring.

13. The hydraulic ram of claim 10 wherein said course scale member is slidably received in said adjustment ring.

14. The hydraulic ram of claim 8 wherein said adjustment ring is mounted on a free end of said cylinder head.

* * * * *